US005511706A

United States Patent [19]

Hendrickson

[11] Patent Number: 5,511,706

[45] Date of Patent: Apr. 30, 1996

[54] HANDCUFF CARRYING APPARATUS

[76] Inventor: Dahl Hendrickson, Rte. 2, Box 135A, El Reno, Okla. 73036

[21] Appl. No.: 378,024

[22] Filed: Jan. 24, 1995

[51] Int. Cl.[6] ..... A45F 5/00

[52] U.S. Cl. ..... 224/269; 224/252; 224/268; 224/914

[58] Field of Search ..... 224/224, 225, 224/240, 242, 247, 248, 249, 251, 252, 255, 256, 265, 269, 914, 253; 24/3.1, 3.6, 3.7, 3.11, 3.12, 336, 343

[56] References Cited

U.S. PATENT DOCUMENTS

| | | | |
|---|---|---|---|
| 928,006 | 7/1909 | Thomas | 24/3.6 |
| 1,025,520 | 5/1912 | Douglass | 224/225 |
| 1,095,247 | 5/1914 | Toce | 24/3.12 |
| 1,270,158 | 6/1918 | Hill | 224/252 |
| 1,392,842 | 10/1921 | Mamalakis | 24/3.6 |
| 1,666,975 | 4/1928 | Monahan | 24/3.12 |
| 1,713,413 | 5/1929 | Yenerall | 224/256 |
| 2,363,065 | 11/1944 | Johnson | 24/3.1 |
| 3,379,349 | 4/1968 | Hier | 224/252 |
| 4,044,933 | 8/1977 | Artz | 224/252 |
| 4,113,156 | 9/1978 | Brito | 224/269 |
| 4,226,105 | 10/1980 | Wehrman | 224/269 |
| 4,358,036 | 11/1982 | Maltais | 224/252 |

*Primary Examiner*—Henry J. Recla
*Assistant Examiner*—Gregory M. Vidovich
*Attorney, Agent, or Firm*—Dunlap & Codding

[57] ABSTRACT

An apparatus for carrying multiple pairs of handcuffs comprising a wristlet retaining member attachable to a belt. The retaining member shaped to define a wristlet receiving slot dimensioned to slidably receive a portion of one of the handcuffs. The retaining member including a biasing portion and a rigid portion with one end of the rigid portion overlapping one end of the biasing portion such that the biasing portion is positioned inwardly adjacent the second end of the rigid portion. The biasing portion selectively movable between a closed position wherein the second end of the biasing portion is biased against the second end of the rigid portion and an open position wherein the second end of the biasing portion is deflected inwardly away from the second end of the rigid portion so as to provide a wristlet receiving passageway in open communication with the wristlet receiving slot and through which one side of one of the wristlets is insertable such that the wristlet is connected to and suspended from the retaining member when the biasing portion is in the closed position.

13 Claims, 3 Drawing Sheets

HANDCUFF CARRYING APPARATUS

BACKGROUND OF THE INVENTION

1. Field of the Invention

The present invention relates generally to carrying devices, and more particularly, but not by way of limitation, to an apparatus for carrying a plurality of handcuffs.

2. Description of Related Art

Law enforcement personnel and prison guards must routinely handcuff a multiple number of prisoners. For example, when a group of prisoners are processed into or transported from a prison, each prisoner must be restrained. In these situations, one guard may be responsible for handcuffing several prisoners.

When guards are required to handcuff a multiple number of prisoners, a problem encountered has been that the guards do not have a convenient and effective way to carry multiple pairs of handcuffs. Until now, guards have carried multiple numbers of handcuffs by stuffing the handcuffs into their pockets and pants so that their hands remain free for the task of putting the handcuffs on the prisoners. Handcuffs are typically constructed of a hard metal, and having their pockets loaded down with several pairs of handcuffs can be extremely uncomfortable for the guards. In addition, it is exceedingly dangerous for a guard to carry several pairs of handcuffs in an unrestrained manner in that a prisoner can gain access to a pair of handcuffs by merely snatching a pair of handcuffs from the guard. The handcuffs can then be used by the prisoner as an effective weapon to injure or incapacitate the guard.

To this end, a need has long existed for an apparatus that can carry multiple pairs of handcuffs in such a manner that permits quick and easy access to handcuffs for authorized personnel, while at the same time retarding unauthorized access. It is to such an apparatus that the present invention is directed.

DETAILED DESCRIPTION

Figure 1:
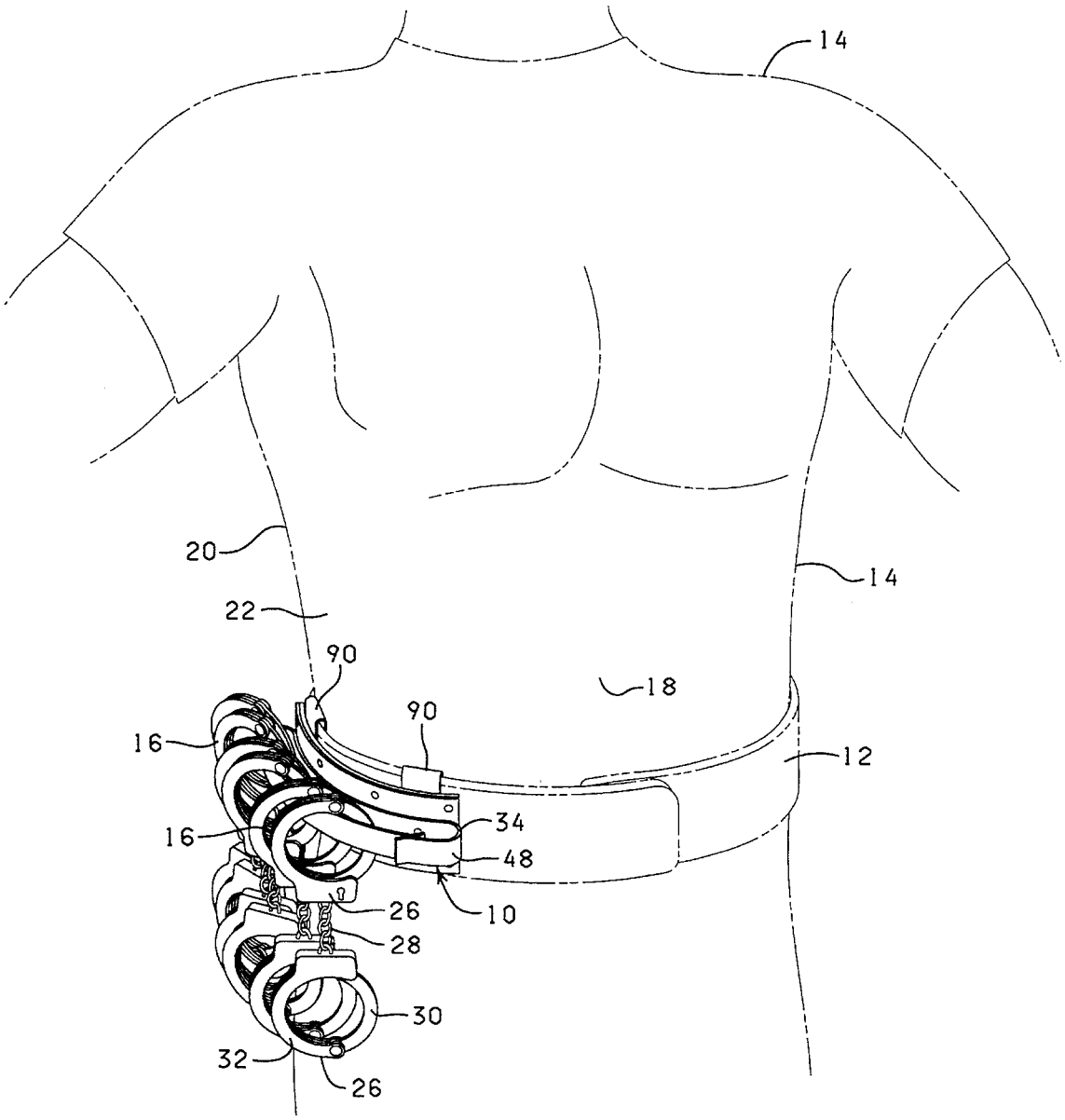
FIG. 1 is a perspective view of an apparatus for carrying multiple pairs of handcuffs constructed in accordance with the present invention showing the apparatus attached to a belt on an individual with several pairs of handcuffs connected thereto.
Figure 2:
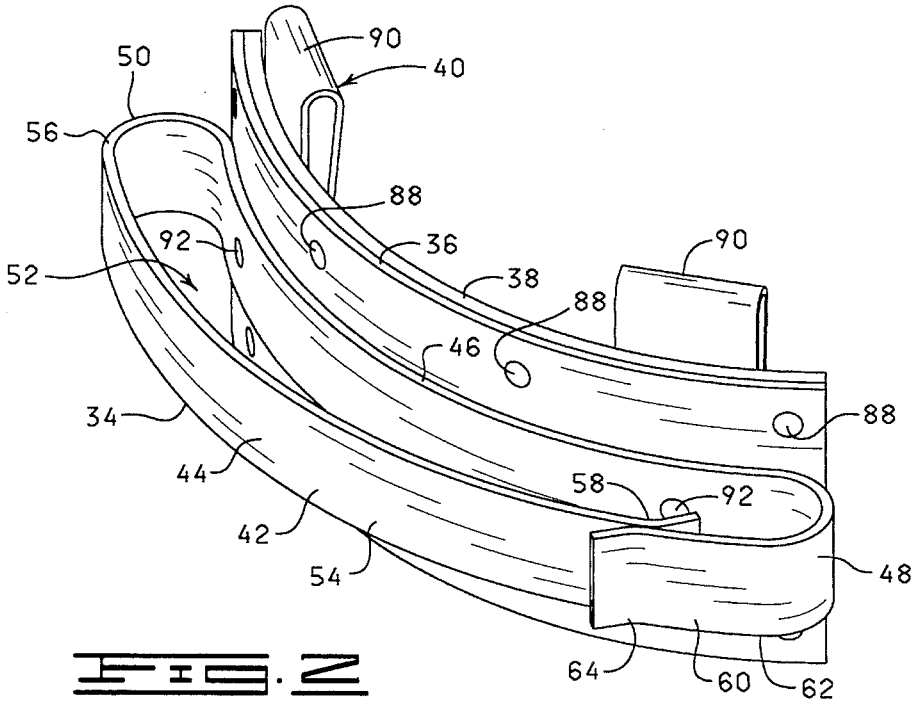
FIG. 2 is a perspective view of the apparatus of the present invention.

Referring now to the drawings, and more particularly to FIG. 1, a handcuff carrying apparatus 10 constructed in accordance with the present invention is shown attached to a belt 12 worn by an individual 14 with a plurality of handcuffs 16 connected to and suspended from the apparatus 10. The individual 14 is characterized has having a front side 18, a back side 20, a right side 22, and a left side 24. The apparatus 10 depicted in FIG. 1 is shown to be attached on the right side 22 of the individual 14.

The handcuffs 16 illustrated herein are conventional double-lock handcuffs. Each of the handcuffs 16 includes a pair of wristlets 26 pivotally and rotatably connected by a link chain 28. Each wristlet 26 comprises a ratchet bar 30 pivotally connected to a double strand wristlet body 32 having internal teeth (not shown) which permit rotation of the ratchet bar 30 only inwardly therethrough, but prevent withdrawal in the opposite direction.

Referring now to FIGS. 2–5, the apparatus 10 includes a wristlet retaining member 34, a base plate 36, a protective backing 38, and an attachment assembly 40. The wristlet retaining member 34 is preferably of unitary construction and formed from a strip of material 42. The strip of material 42 is preferably a mild spring steel, such as an annealed 1095 steel. However, it will be appreciated by those skilled in the art that the retaining member 34, as well as other components of the apparatus 10 described below, can be constructed of a variety of durable materials having elastic properties, such as plastic.

The strip of material 42 is shaped to form an elongated, looped configuration having an arc shaped outward side 44, an arc shaped inward side 46 spaced from and substantially parallel to the outward side 44, an arcuate first end 48, and an arcuate second end 50. The outward side 44, the inward side 46, the first end 48, and the second end 50 of the retaining member 34 cooperate to define an elongated wristlet receiving slot 52 dimensioned to accommodate a portion of a plurality of wristlets 26.

The arc shape of the outward side 44 and the inward side 46 substantially conform to the contour of the individual when the apparatus 10 is attached to one of the sides of the individual 14 such that the retaining member 34 is sufficiently sized to accommodate and carry a plurality of handcuffs 16, and yet, the apparatus 10 does not protrude significantly from the side of the individual 14 when the apparatus 10 is worn by the individual 14. It will be appreciated, however, that the retaining member 34 may be formed into various sizes and geometric shapes, such as round, square or rectangular.

The outward side 44 of the retaining member 34 includes a biasing portion 54 having a first end 56 and a second end 58, and a rigid portion 60 having a first end 62 and a second end 64. The first end 56 of the biasing portion 54 is connected to the second end 50 of the retaining member 34, and the first end 62 of the rigid portion 60 is connected to the first end 48 of the retaining member 34. The rigid portion 60 is formed so as to have a length 66 (FIG. 4) which provides a rigid member; whereas the biasing portion 54 is formed so as to have a length 68 (FIG. 4) sufficient to provide the biasing portion 54 with a spring characteristic.

Figure 4:
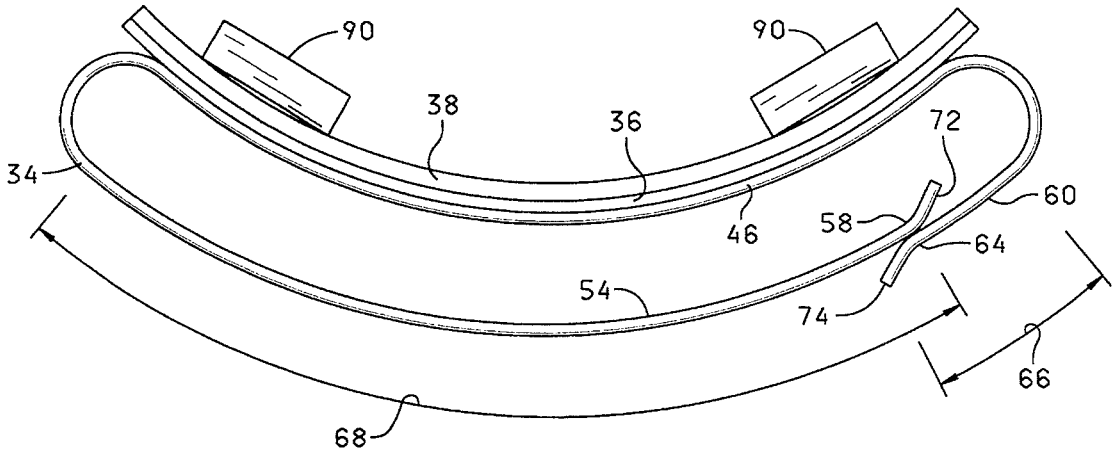
FIG. 4 is a top view of the apparatus of the present invention showing the apparatus in a closed position.
Figure 5:
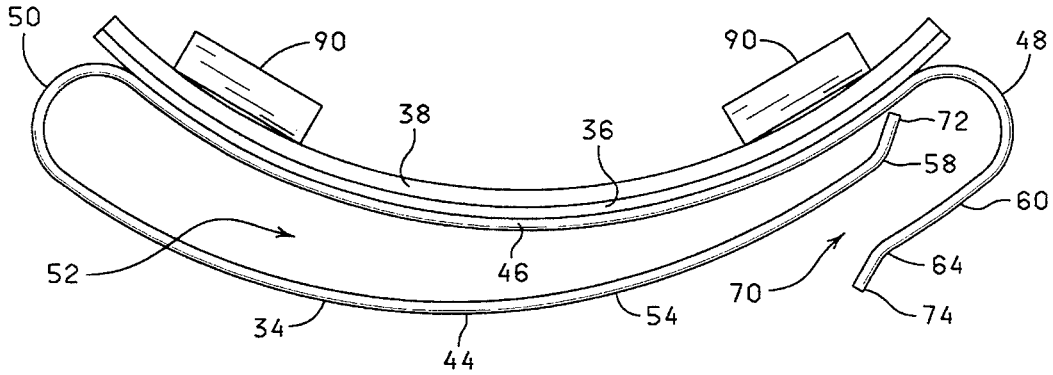
FIG. 5 is a top view of the apparatus of the present invention showing the apparatus in an open position.

As best shown in FIG. 4, the second end 64 of the rigid portion 60 is extended so as to overlap the second end 58 of the biasing portion 54 such that the second end 58 of the biasing portion 54 is positioned inwardly adjacent the second end 64 of the rigid portion 60. Due to the spring characteristic of the biasing portion 54, the second end 58 of the biasing portion 54 is selectively positionable between a closed position (FIG. 4) wherein the second end 58 of the biasing portion 54 is biased against the second end 64 of the rigid portion 60, and an open position (FIG. 5) wherein the second end 58 of the biasing portion 54 is deflected inwardly away from the second end 64 of the rigid portion 60 so as to provide a wristlet receiving passageway 70. The wristlet receiving passageway 70 formed between the second end 58 of the biasing portion 54 and the second end 64 of the rigid portion 60 is in open communication with the wristlet receiving slot 52, thereby enabling a portion of the wristlets 26 to be slidably disposed into the wristlet receiving slot 52 such that the wristlets 26 are disposed about the rigid portion 60 of the retaining member 34.

To facilitate the insertion and removal of the wristlets 26 from the retaining member 34 via the wristlet receiving passageway 70, the second end 58 of the biasing portion 54 is provided with an inwardly curved lip 72 and the second end 64 of the rigid portion 60 is provided with an outwardly curved lip 74. The lip 72 on the second end 58 of the biasing portion 54 is sufficiently spaced from the inward side 46 of the retaining member 34 so that the wristlets 26 disposed initially on the rigid portion 60 are slidable along the length of the retaining member 34 and suspendable from one of the first end 48, the second end 50, the rigid portion 60, and the biasing portion 54 when the biasing portion 54 is in the closed position.

The overlapping relationship of the biasing portion 54 and the rigid portion 60 further functions to secure the handcuffs 16 on the retaining member 34 when the biasing portion 54 is in the closed position. That is, when the handcuffs 16 are connected to the retaining member 34 and the biasing portion 54 is in the closed position, the removal of the handcuffs 16 from the retaining member 34 by merely trying to pull the handcuffs 16 through the wristlet receiving passageway 70 is retarded in that the force exerted on the biasing portion 54 by one of the handcuffs 16 being pulled between the lip 72 of the biasing portion 54 and the rigid portion 60 does not produce an inward force component great enough to deflect the biasing portion 54 away from the rigid portion 60. As such, to remove the handcuffs 16 from the retaining member 34 the biasing portion 54 must be moved to the open position by deflecting the biasing portion 54 away from the rigid portion 60 by pressing inwardly directly on the biasing portion 54. The necessity of having to directly press on the biasing portion 54 serves to retard access by unauthorized personnel to the handcuffs 16 connected to the retaining member 34.

The rigid portion 60 and the biasing portion 54 are dimensioned such that the wristlet receiving passageway 70 is formed on the outward side 44 of the retaining member 34 near the first end 48 thereof. This arrangement permits the first end 48 of the retaining member 34 to be positioned toward the front side 18 of the individual 14 when the retaining member 34 is attached on the right side 22 of the individual 14 and the first end 48 to be positioned toward the front side 18 of the individual 14 when the retaining member 34 is attached on the left side 24 of the individual 14 so that the wristlet receiving passageway 70 is located toward the front side 18 of the individual 14 to facilitate removal of the handcuffs 16 from the retaining member 34 by the individual 14. The apparatus 10 depicted in FIGS. 1–2 and 4–5 is assembled so as to be positioned on the right side 22 of the individual 14. To position the first end 48 on the left side 24, the retaining member 34 is simply turned over so that the first end 48 is oriented toward the front of the individual 14 and the attachment assembly 40 is turned over.

Figure 3:
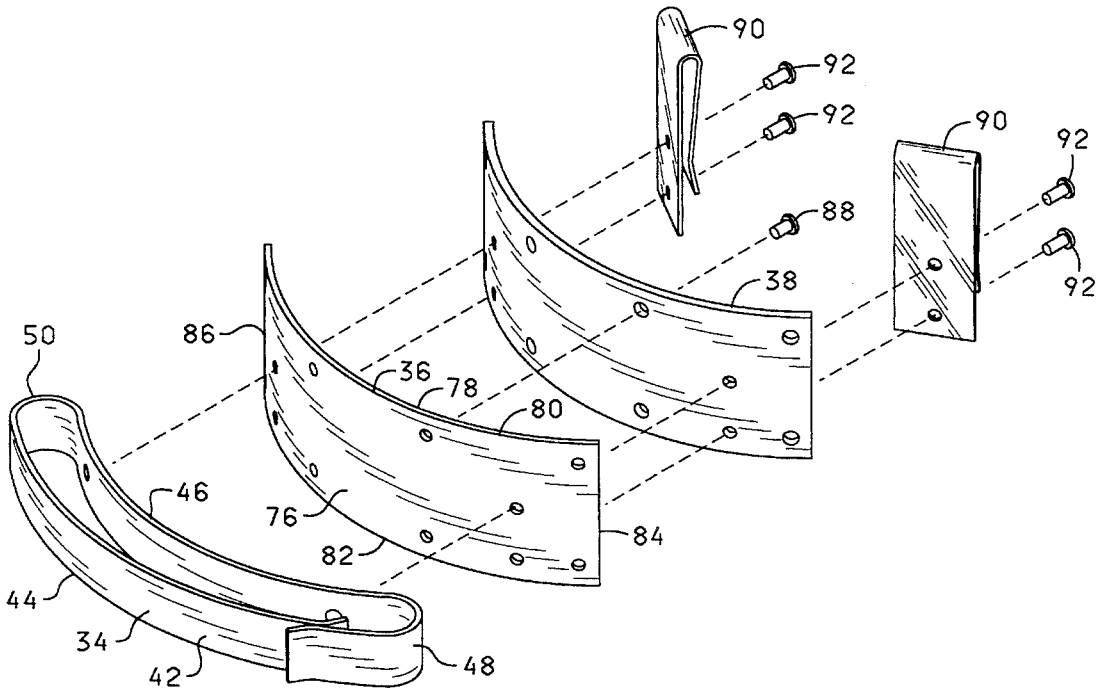
FIG. 3 is an exploded view of the apparatus of the present invention.

To provide support to the retaining member 34, the retaining member 34 is connected to the base plate 36. As best shown in FIG. 3, the base plate 36 is a rigid plate member having a front side 76, a back side 78, an upper side 80, a lower side 82, a first end 84, and a second end 86. The front side 76 of the base plate 36 is connected to the inward side 46 of the retaining member 34. The base plate 36 is contoured to substantially conform to the shape of the individual 14, and thus also the inward side 46 of the retaining member 34. The retaining member 34 is connected to the front side 76 of the base plate 36 in any suitable manner such as by welding.

The protective backing 38 is connected to the back side 78 of the base plate 36 to prevent the belt 12 from being scuffed or otherwise damaged. The protective backing 38 can be any suitable material that will not scuff or damage the belt 12. The protective backing 38 is illustrated herein as being relatively soft plastic contoured and connected to the back side 78 of the base plate 36 with a plurality of pop rivets 88. However, it will be realized that the base plate 36 can be covered with a leather or other material that will prevent damage to the belt 12.

In that a prison guard only periodically needs to carry multiple pairs of handcuffs, it is desirable that the apparatus 10 be easy to attach and remove from the belt 12. To this end, the attachment assembly 40 is preferably a pair of clips 90 secured to the base plate 36 with a plurality of rivets 92 or in some other suitable fashion. It will be understood that the clips 90 will be reversed relative to that shown in FIGS. 1–5 when the apparatus 10 is intended to be attached to the left side 24 of the individual 14. Alternatively, the attachment assembly 40 could comprise a belt receiving loop (not shown) or a belt could be incorporated into the apparatus 10 whereby the apparatus 10 is attached to the individual 14 by securing the belt to the individual 14.

In operation, prior to processing or transporting a group of prisoners the apparatus 10 is loaded with several pair of handcuffs 16. The handcuffs 16 are loaded onto the apparatus 10 by moving the biasing portion 54 of the retaining member 34 to the open position (FIG. 5) and simultaneously inserting one of the wristlets 26 over the rigid portion 60. The biasing portion 54 is then moved to the closed position (FIG. 4) and the handcuff 16 is slid between the lip 72 on the second end 58 of the biasing portion 54 and the inward side 46 so as to make room for the insertion of another pair of handcuffs 16 on the rigid portion 60. It will be realized that the handcuffs 16 can also be positioned on the retaining member 34 by inserting the ratchet bar 30 of one of the wristlets 26 through the wristlet receiving slot 52 when the wristlet 26 is in an open position. Once positioned through the wristlet receiving slot 52 the wristlet 26 is closed with the retaining member 34 disposed through the closed wristlet 26 thereby connecting the handcuffs 16 to the retaining member 34.

With the apparatus 10 loaded with the desired number of handcuffs 16, the apparatus 10 is attached to the individual 14 by inserting the clips 90 of the apparatus 10 over the belt 12 with the protective backing 38 being disposed against the belt 12. As mentioned above, the apparatus 10 is preferably attached to the individual 14 so that the wristlet receiving passageway 70 is positioned toward the front side 18 of the individual 14 to facilitate removal of the handcuffs 16 from the retaining member 34. To remove a pair of the handcuffs 16 from the retaining member 34, the biasing portion 54 is deflected to the open position and the wristlet 26 disposed about the rigid portion 60 is slid along the rigid portion 60 such that a portion of the wristlet 26 passes between the second end 58 of the biasing portion 54 and the second end 64 of the rigid portion 60 thereby disconnecting the wristlet 26 from the retaining member 34.

The advantage of utilizing the present invention is that a prison guard can carry multiple pairs of handcuffs in an orderly manner and in a manner that permits quick and easy access to the handcuffs for the prison guard. In addition, the present invention retards access to the handcuffs by the prisoners, thereby providing greater protection to the prison guard during the process of restraining a prisoner with handcuffs.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. A security apparatus comprising:

a plurality of pairs of handcuffs, each pair of handcuffs comprising a pair of interconnected wristlets; a wristlet pretaining member having an outward side, an inward side, a first end, and a second end cooperating to define a wristlet receiving slot dimensioned to slidably receive a portion of at least one of the wristlets of each pair of handcuffs, at least one of the wristlets of each pair of handcuffs connected to the wristlet retaining member such that each of the handcuffs is slidably interlocked with the wristlet retaining member with respect to said slot, the outward side of the retaining member including a rigid portion and a biasing portion having a first end and a second end, the second end of the biasing portion positioned adjacent the rigid portion such that the second end of the biasing portion is selectively movable between a closed position wherein the second end of the biasing portion is biased against the rigid portion to retain the wristlets on the wristlet retaining member and an open position wherein the second end of the biasing portion is deflected away from the rigid portion so as to provide a wristlet receiving passageway in open communication with the wristlet receiving slot and through which the portion of the wristlets disposed in the wristlet receiving slot is slidably passable for disconnecting the wristlet from the wristlet retaining member; and attachment means for attaching the wristlet retaining member to a belt positioned about the waist of an individual.

2. The apparatus of claim 1 wherein the wristlet retaining member is horizontally oriented when attached to the belt such that the wristlets interlocked with the wristlet retaining member are substantially horizontally aligned with one another.

3. The apparatus of claim 1 wherein the outward side of the retaining member is spaced from the inward side in a substantially parallel relation, and wherein the outward side and the inward side of the retaining member are substantially arc shaped.

4. The apparatus of claim 1 wherein the retaining member is of unitary construction.

5. The apparatus of claim 1 further comprising:

a rigid base plate having a front side, a back side, an upper side, a lower side, a first end, and a second end, the front side of the base plate being connected to the inward side of the wristlet retaining member.

6. The apparatus of claim 5 wherein the base plate is contoured to conform to the shape of the inward side of the retaining member.

7. The apparatus of claim 6 further comprising:

a protective backing connected to the back side of the support plate and engagable against the belt when the retaining member is attached to the belt.

8. The apparatus of claim 5 wherein the attachment means comprises a pair of clips secured to the base plate.

9. A handcuff carrying apparatus in combination with multiple pairs of handcuffs, each pair of handcuffs comprising a pair of interconnected wristlets, the handcuff carrying apparatus comprising:

a wristlet retaining member of unitary construction having an arc shaped outward side, an arc shaped inward side spaced from the outward side in a substantially parallel relation, an arcuate first end, and an arcuate second end, the outward side, the inward side, the first end and the second end cooperating to define a wristlet receiving slot dimensioned to slidably receive a portion of at least one of the wristlets of each pair of handcuffs, at least one of the wristlets of each pair of handcuffs connected to the wristlet retaining member such that each of the handcuffs is slidably interlocked with the wristlet retaining member with respect to said slot, the outward side of the retaining member including a biasing portion having a first end and a second end and a rigid portion having a first end and a second end, the second end of the biasing portion overlapping the second end of the rigid portion such that the second end of the biasing portion is selectively movable between a closed position wherein the second end of the biasing portion is biased against the rigid portion to retain the wristlets on the wristlet retaining member and an open position wherein the second end of the biasing portion is deflected away from the rigid portion so as to provide a wristlet receiving passageway in open communication with the wristlet receiving slot and through which the portion of the wristlets disposed in the wristlet receiving slot is slidably passable for disconnecting the wristlet from the wristlet retaining member;

a rigid base plate having a front side, a back side, an upper side, a lower side, a first end, and a second end, the base plate substantially contoured to conform to the shape of the inward side of the wristlet retaining member and a portion of a waist of an individual when disposed adjacent to the waist of the individual, the front side of the base plate connected to the inward side of the wristlet retaining member;

a protective backing disposed over the back side of the base plate; and attachment means for removably attaching the wristlet retaining member, the base plate and the protective backing to a belt positionable about the waist of the individual with the protective backing disposed against the belt and such that the wristlet retaining member is horizontally oriented when attached to the belt and the wristlets interlocked with the wristlet retaining member are substantially horizontally aligned with one another.

10. A method of carrying multiple pairs of handcuffs wherein each of the pairs of handcuffs comprises a pair of interconnected wristlets, the method comprising the steps of:

providing a wristlet retaining member with the wristlet retaining member having an outward side, an inward side, a first end, and a second end cooperating to define a wristlet receiving slot dimensioned to slidably receive a portion of at least one of the wristlets of each pair of handcuffs, the outward side of the wristlet retaining member including a rigid portion a biasing portion having a first end and a second end, the second end of the biasing portion positioned adjacent the rigid portion such that the second end of the biasing portion is selectively movable between a closed position wherein the second end of the biasing portion is biased against the rigid portion and an open position wherein the second end of the biasing portion is deflected away from the rigid portion so as to provide a wristlet receiving passageway in open communication with the wristlet receiving slot;

connecting at least one of the wristlets of each of the pairs of handcuffs to the wristlet retaining member such that at least one of the wristlets of each pair of handcuffs is slidably interlocked with the wristlet retaining member; and attaching the wristlet retaining member to a belt worn by an individual.

11. The method of claim 10 wherein the attaching step further comprises attaching the wristlet retaining member to the belt such that the wristlet retaining member is horizontally oriented such that the wristlets interlocked with the wristlet retaining member are substantially horizontally aligned with one another.

12. The method of claim 10 further comprising the step of:

selectively removing one of the pairs of handcuffs from the wristlet retaining member while retaining the other pairs of handcuffs on the wristlet retaining member.

13. The method of claim 12 wherein the step of removing one of the pairs of handcuffs comprises the steps of:

selecting one of the pairs of handcuffs connected to the wristlet retaining member;

deflecting the biasing portion of the wristlet retaining member to the open position; and passing the wristlet of the selected pair of handcuffs through the wristlet receiving passageway so as to disconnect the wristlet from the wristlet retaining member.

* * * * *

UNITED STATES PATENT AND TRADEMARK OFFICE

CERTIFICATE OF CORRECTION

PATENT NO. : 5,511,706

DATED : April 30, 1996

INVENTOR(S) : Hendrickson

It is certified that error appears in the above-identified patent and that said Letters Patent is hereby corrected as shown below:

Column 5, lines 15-17, please delete

"a plurality of pairs of handcuffs, each pair of handcuffs comprising a pair of interconnected wristlets; a wristlet pretaining member having an outward side, an inward"

and substitute therefor

--a plurality of pairs of handcuffs, each pair of handcuffs comprising a pair of interconnected wristlets;

a wristlet retaining member having an outward side, an inward--.

Column 6, line 63, after "rigid portion" please insert --and--.

Signed and Sealed this

Twentieth Day of August, 1996

Bruce Lehman

*Attest:*

BRUCE LEHMAN

*Attesting Officer*

*Commissioner of Patents and Trademarks*